US005365754A

United States Patent [19]

Nalbandian

[11] Patent Number: 5,365,754

[45] Date of Patent: Nov. 22, 1994

[54] MAGNIFYING GEM HOLDER

[75] Inventor: Gevork Nalbandian, Atwater Village, Calif.

[73] Assignee: Pan American Diamond Corp., New York, N.Y.

[21] Appl. No.: 748,426

[22] Filed: Aug. 22, 1991

[51] Int. Cl.[5] ..... A44C 17/02

[52] U.S. Cl. ..... 63/26; 63/12

[58] Field of Search ..... 63/12, 13, 14, 15, 26, 63/29.1

[56] References Cited

U.S. PATENT DOCUMENTS

| | | | |
|---|---|---|---|
| 830,179 | 9/1906 | Sadler | 63/26 |
| 837,615 | 12/1906 | Dover . | |
| 1,319,251 | 10/1919 | Schless | 63/26 |
| 1,389,031 | 3/1921 | Cumming . | |
| 1,449,158 | 3/1923 | Wittstein | 63/26 |
| 1,726,926 | 9/1929 | Schwartz . | |
| 1,850,728 | 3/1932 | Schless . | |
| 2,069,598 | 2/1937 | Arpels . | |
| 2,273,227 | 2/1942 | Simmons | 63/26 |
| 3,862,550 | 1/1975 | Sengenberger | 63/29.1 |
| 3,898,869 | 8/1975 | Reneer | 63/26 |
| 4,294,084 | 10/1981 | Lampert | 63/15 |
| 4,301,134 | 11/1981 | Strong | 63/32 |
| 4,800,738 | 1/1989 | Bunz . | |
| 5,044,177 | 9/1991 | Favre | 63/26 |

FOREIGN PATENT DOCUMENTS

| | | | |
|---|---|---|---|
| 2613678 | 3/1976 | Germany . | |
| 235779 | 6/1925 | United Kingdom | 63/26 |
| 425798 | 3/1935 | United Kingdom | 63/26 |

*Primary Examiner*—Michael J. Milano

*Attorney, Agent, or Firm*—Amster, Rothstein & Ebenstein

[57] ABSTRACT

A gem holder for magnifying and enhancing the appearance of gems set therein. The gem is set within the magnifying gem holder so that it is recessed away from the topmost edge of the holder. The gem holder is highly polished and is coated with a reflective coating near its top. The appearance of the gem set within the gem holder is magnified as the light reflected by the topmost portion of the gem holder appears to be the light from a gem the size of the gem holder, and not the smaller gem so held. The gem holder may be incorporated into earrings, rings, bracelets, anklets, necklaces, and the like.

15 Claims, 3 Drawing Sheets

FIG. 1
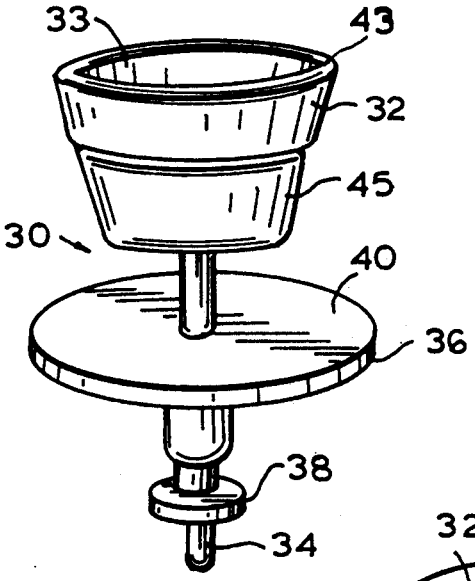
FIG. 3
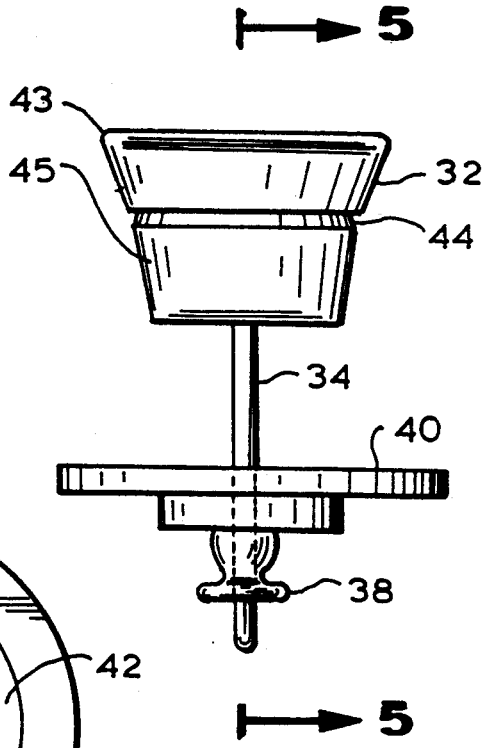
FIG. 2
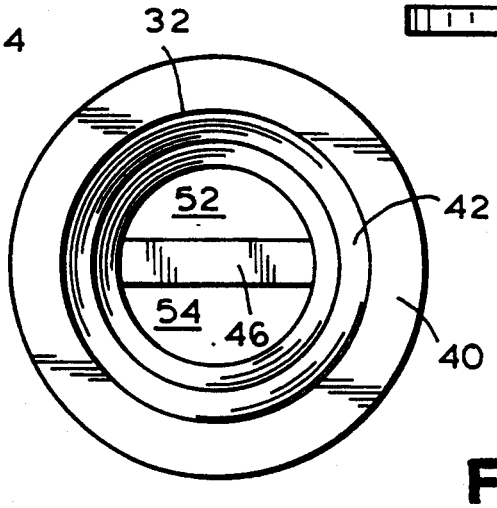
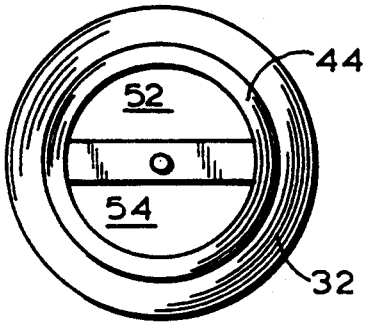
FIG. 4
FIG. 6
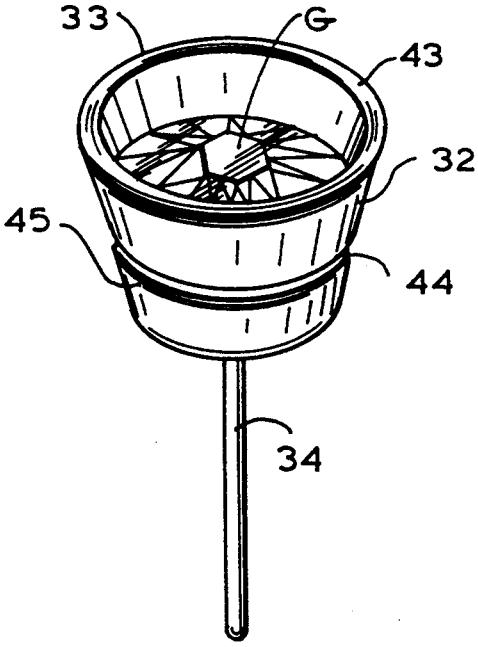

FIG. 10
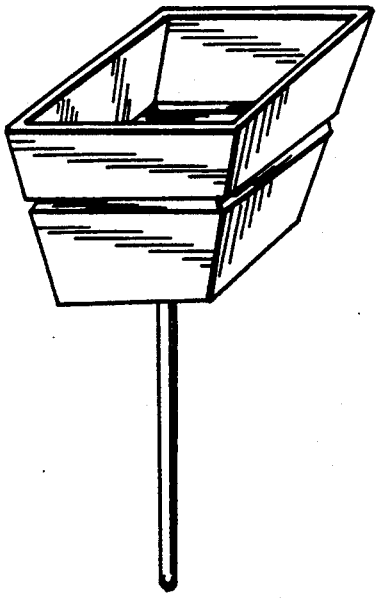
FIG. 11
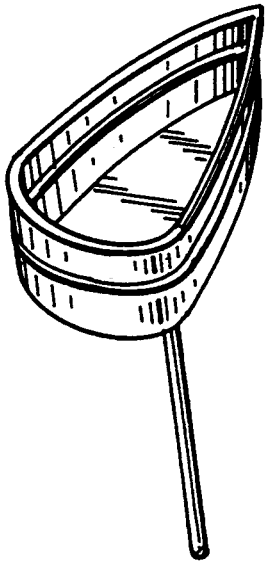
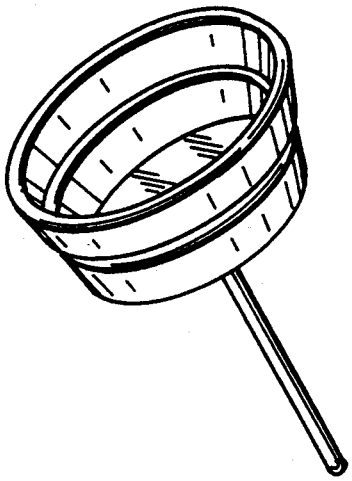
FIG. 12
FIG. 13
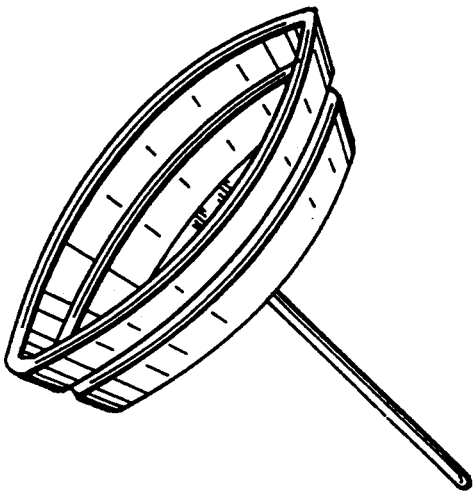

MAGNIFYING GEM HOLDER

BACKGROUND OF THE INVENTION

1. Field of the Invention

This invention relates to jewelry and more particularly to gem settings and related structures.

2. Introduction

Gems such as diamonds, rubies, and emeralds are often cut into standard shapes and sizes that enhance the gem's appearance. One such standard is the 6.5 millimeter diameter standard presently used for diamonds of one carat. However, despite the precious nature of gems, significant variance may be present between any two randomly selected, cut gems of the same weight. Gems on the order of 1.20 carats are sometimes considered to be the same as 1.00 carat gems. The size and cut of gems affect their characteristics.

Light reflected and refracted by the gem and their deep, rich colors have appealed to many people over the course of several hundred years. Also, the fungible and lasting nature of gems has provided investment opportunities or means to tangibly secure liquid assets.

In order to attach gems to the human body, settings are needed. Such settings are used in earrings, rings for fingers, bracelets, anklets, necklaces, and the like. Most of these settings use thin prongs to hold the gem in place without detracting from the gem's appearance. While adequately displaying the gem, such settings do not necessarily complement or enhance the appearance of the gem.

Attempts have been made to enhance a gem's appearance through its setting, but these have made minimal progress in the art. One such example is that of the TRUBRILLIANT series of diamond settings marketed by Feature International. While the Trubrilliant series of settings claims to enhance the appearance of diamonds by making them appear twenty-five percent larger, it is believed that such an effect is achieved by merely etching the setting near the diamond so that more surface area of the setting is exposed to an observer.

Most gems are precious and expensive, demanding high prices in the marketplace. Gem prices are related to the size and clarity of the gem. Larger and clearer gems command higher prices than smaller and flawed ones.

Much of the satisfaction that comes with the ownership or wearing of precious gems comes from the gem's appearance. It can be seen that enhancement by the setting of a gem's appearance provides several advantages: a lower cost is required for a gem that can be made to appear larger; more satisfaction is derived from owning/wearing a gem that appears larger; and clearer, smaller stones may be purchased yet achieve a visual appearance connected with a larger stone.

SUMMARY OF THE INVENTION

A gem is set in a housing that reflects the gem's light. The top of the housing reflects light, including the light of the gem. The gem is recessed away from the top edge of the housing so that more light of the gem may be reflected by the housing top. The housing is conical, with the conical angle of the housing varying with the size of the gem. Larger angles are used for larger stones, and vice-versa. The housing magnifies the appearance of the gem and may be incorporated into earrings, rings, bracelets, anklets, necklaces, and the like.

OBJECTS OF THE INVENTION

It is an object of this invention to provide a gem setting that magnifies the gem set therein.

It is another object of this invention to provide a gem setting that magnifies the gem set therein at a low and reasonable cost.

These and other objects and advantages of the present invention will be apparent from a review of the following specification and accompanying drawings.

BRIEF DESCRIPTION OF THE DRAWINGS

FIG. 1 is a side perspective view of an earring embodiment of the gem holder of the present invention, including the post holder.

FIG. 2 is a top plan of the gem holder of FIG. 1.

FIG. 3 is a side plan view of the gem holder of FIG. 1, showing in phantom the post portion within the post holder.

FIG. 4 is a bottom plan view of the gem holder of FIG. 1 without the post holder.

FIG. 6 a top perspective view of the gem holder of FIG. 1 without the post holder and showing a gem set therein.

FIG. 10 is an alternative embodiment of the earring embodiment of the present invention for a square or princess cut gem.

FIG. 11 is another alternative earring embodiment of the gem holder for a pear-shaped gem.

FIG. 12 is another alternative earring embodiment of the gem holder for an oval-shaped gem.

FIG. 13 is another alternative earring embodiment of the present invention for a marquis-shaped gem.

DESCRIPTION OF THE PREFERRED EMBODIMENT

Figure 5:
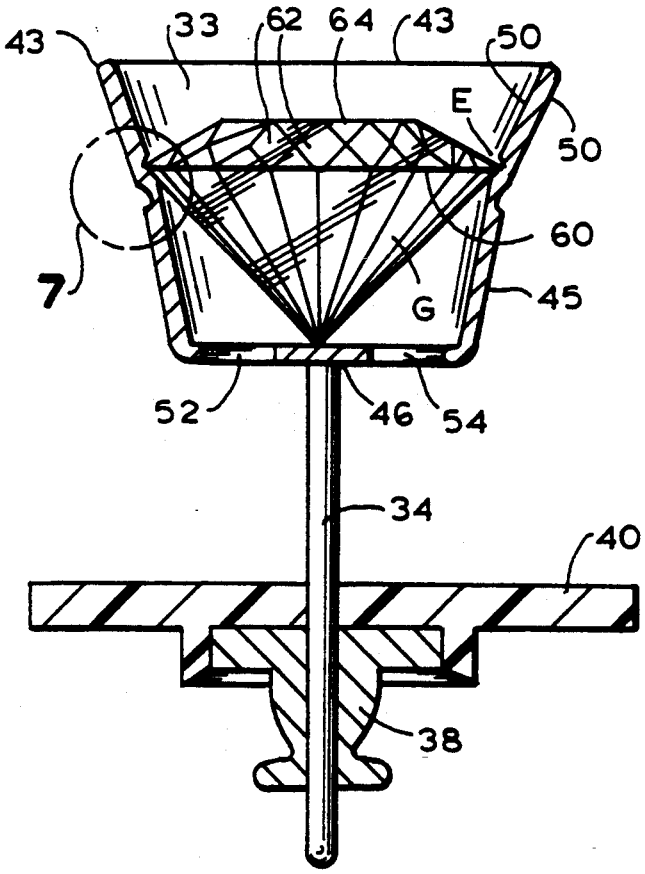
FIG. 5 is a view of the gem holder of FIG. 3 generally along line 5—5.

Referring to FIG. 1, the present invention is shown in the preferred embodiment as an earring 30 for pierced ears. A gem housing 32 has the shape of a cup or container and holds a gem G securely within its interior 33. A post 34 is connected to the bottom of housing 32, and runs perpendicularly away from the housing 32. A post holder 36 fits over and securely slides upon the post 34. The post holder 36 may have two portions: a post holding portion 38, and a pressure distributor 40 connected to or coupled with the post holding portion 38.

Figure 7:
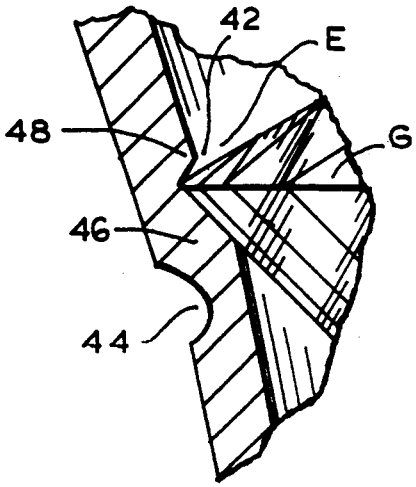
FIG. 7 is an enlarged view of the gem holder of FIG. 5 generally at encircled portion 7.

As seen in FIGS. 2, 5, and 7, a groove or channel 42 is present within the interior 33 of the gem housing 32 below the top edge 43 of the housing 32. Another groove or channel 44 is preferably present on the outside 45 of the gem housing 32. In FIGS. 2 and 4, a small band 46 connects opposite sides of the gem housing 32 and provides attachment for the post 34 to the gem housing 32. The small band 46 may be integrally formed with the housing 32, or attached separately.

Reflective precious or semi-precious metals (such as polished 14 k or 18 k gold or platinum) are used to construct the earring 30. Male and female form dies (not shown) are used to form the housing 32 from a flat sheet of the ornamental metal approximately forty one-thousandths of an inch thick. The metal is stamped into a circle or other useful shape by a blank die. The blank so stamped is then set over the form die. The male form die is approximately two millimeters smaller than the female form die so that when the metal blank is punched, there is room for the metal between the male and female form dies. The metal blank is so punched by the form dies and formed into a cone with a flat bottom. The angle of the stamped metal cone is determined by the die and this angle is varied according to the size of the gem.

Alternatively, the housing 32 may be cast from a mold into which molten metal is poured. Casting the housing 32 avoids possible further tooling of the housing, with any apertures or grooves to be set into the housing 32 reflected in the mold.

Most gems, especially diamonds, are measured in points. A point is a one one-hundredth of a carat. It is contemplated that for a diamond weighing approximately five to fifteen points, the angle of the metal cone formed by the male and female form dies is approximately eight to twelve degrees from the vertical for a total angle of approximately sixteen to twenty-four degrees side to side. For gems weighing approximately fifteen to twenty-five points, the angle of the cone is approximately twelve to fifteen degrees from the vertical for a total angle of approximately twenty-four to thirty degrees from side to side. For gems weighing approximately twenty-five to fifty points, the angle of the cone is approximately fifteen to eighteen degrees from the vertical for a total angle of approximately thirty to thirty-six degrees from side to side.

For gems weighing approximately fifty to one-hundred points (one-half to one carat), the angle of the cone is approximately eighteen to twenty-one degrees from the vertical for a total angle of approximately thirty-six to forty-two degrees from side to side. For gems weighing approximately one to one and one-half carats, the angle of the cone is approximately nineteen to twenty-two degrees from the vertical for a total angle of approximately thirty-eight to forty-four degrees. For gems weighing approximately one and one-half to two carats, the angle of the cone is approximately twenty-one to twenty four degrees from the vertical for a total angle of approximately forty-two to forty-eight degrees.

A summary of the gem weight/cone angle relationships is shown below in the table.

| Approximate Gem Weight (carats) | Approximate Cone Angle (from the vertical) |
|---|---|
| 0.05–0.15 | 8–12° |
| 0.15–0.25 | 12–15° |
| 0.25–0.50 | 15–18° |
| 0.50–1.00 | 18–21° |
| 1.00–1.50 | 19–22° |
| 1.50–2.00 | 21–24° |

From these examples, it is believed that proper dies and gem holders formed from those dies can be made. Extrapolation of these examples is believed to yield appropriate conical angles for gems lighter and heavier than ones for the given weights without great difficulty. Variations between gemstones require the jeweler to use his own Judgment in choosing both the angle of the housing 32 and the depth of the gem G within the housing 32 so that the gem G is presented in its most appealing manner.

After the cone is formed by the form dies, a piercing die removes some of the flat, bottom portion of the stamped metal cone. The interior 33 of the conic metal housing 32 is polished to a high degree to enhance the appearance of a gemstone set therein.

To better present the gem G in its housing 32., the gem G is set within the housing 32 and visually inspected. The jeweler can adjust the gem within the housing 32, or choose a more appropriate housing 32, before engraving the interior groove 42 into the interior 33 of housing 32. If the housing 32 is cast, then the interior groove 42 may be created during the casting process (as may any bottom apertures or bands).

A groove 44 or grooves (FIG. 8) may be cut into the exterior 45 of the housing 32. One advantage of cutting an external groove 44 before setting the gem G in the housing 32 is that the external groove 44 may be positioned relative to the interior groove 42 so that the metal housing 32 flexes between the interior 42 and exterior 44 grooves. The exterior groove 44 also complements the appearance of the housing 32.

Once the interior groove 42 has been cut and the gem G is ready to be set, the gem G is forced into the housing by conventional means, including a stamp, a punch, or a similar device. When seated in the interior groove 42, the gem G is recessed away from the top edge 43 of the housing 32. The depth to which the gem G is recessed is related to the size, weight, and diameter of the gem, with the jeweler tailoring the housing 32 to the gem G. Larger gems may be set more deeply within the interior 33 of the housing 32 while smaller gems are set closer to the top edge 43 of the housing 32.

While friction, adhesion, or other known means may be sufficient to hold the gem G securely within the interior 33 of housing 32, the interior groove 42 provides the gem G with a circumferential notch within which the edge E of the gem G fits. By fitting within the interior groove 42, the gem G is more tightly and securely held in place within the interior 33 of housing 32. The circumference of the housing interior 33 just above the interior groove 42 is slightly smaller than the perimeter of the edge E of the gem G. There is a tight fit between the gem G and the housing interior 33 just above interior groove 42. Pressure exerted by the housing 32 upon the gem G when the gem G is pushed into the housing 32. This pressure is relieved when the gem's edge E snap fits within the interior groove 42. Gem G is prevented from traveling further down the housing interior 33 as the conic shape of the housing 32 presents to the gem G an even smaller interior 33 circumference below the interior groove 42 than is present above the interior groove 42. Preferably, the interior groove 42 has the same circumference as and closely conforms to the gem's edge E. In one embodiment, the interior groove 42 is twenty-five thousandths of an inch wide and five thousandths of an inch deep.

To further secure the gem within the housing 32, "bits" may be pulled from the interior 33 of the housing 32 just above the gem G and the interior groove 42. These "bits" are pulled or cut from the interior 33 of the housing 32 by an engraving tool. These "bits" are small metal burrs of the housing 32 pulled from its interior 33 very close to the gem G. The bits are firmly attached to the housing interior 33 at their base, but the ends are free and face toward the gem G. The gem G is then impeded in its upward movement by the burrs as act somewhat like a barb on a hook. An item more easily slides onto the hook and is not impeded by the barb while items are snagged by the hook should they try to slide off. Here, the gem G is "snagged" by the bits should the gem G try to slide or slip out of the housing 32.

In order to force the gem G into the housing 32, either the housing 32 or the gem G must bend, stretch, or flex so that the gem G can slip into the interior groove 42. If the gem G to be set is a diamond and the precious metal used for the housing is gold, it will be the gold that changes its shape. This is so as diamond is one of the hardest materials while gold is a soft metal.

In pushing the gem G into the housing 32, it may be possible to deform and damage the housing. One possible way to avoid this is by providing some means by which the housing 32 can flex around the gem G. As shown in FIGS. 5 and 7, an exterior groove 44 may be cut into the housing 32 just below the interior groove 42. If the exterior groove 44 is properly positioned, a portion 46 of the housing 32 between the interior 42 and exterior 44 grooves is made thinner than the rest of the housing 32. This circle of thinner material 46 can flex more easily than other portions of the housing 32 when the gem G is pushed into the interior groove 42. The thin circle 46 of the housing 32 is not so thin as to structurally impair the integrity of the housing 32.

When the gem G is pushed into the interior groove 42, it first comes into contact with the housing 32 interior immediately above the interior groove 42. When the gem G is pushed further into the housing 32, pressure is generated between the gem G and the housing 32. This pressure may be sufficient to locally deform the housing 32 unless the pressure is relieved. In deforming the housing 32, the pressure could force the upper edge 48 of the interior groove 42 back into the interior groove 42 itself. Should this deformation occur, the gem G would be less securely held within the housing 32 due to a less well-defined interior groove 42.

With the presence of the thinner housing portion 46 between interior 42 and exterior 44 grooves, pressure present between the housing 32 and the gem G may be transmitted to the thinner portion 46. The thinner portion 46 can then flex and stretch to accommodate the gem without suffering deformation, or else reduce deformation. The interior groove 42 can better retain its definition and more securely hold the gem G due to the transmission of pressure to the thinner portion 46 of the housing 32.

The thinner portion 46 of the housing 32 is immediately beneath the portion 48 of the housing interior 33 that first contacts the gem's edge E when the gem G is pushed into the interior groove 42. Should the thinner portion 46 be deformed by the insertion of the gem G into the interior groove 42, the overall visual appeal of the earring 30 can be retained as the deformed thinner portion 46 is at least partially obstructed from view by the portion of the gem holder above the thinner portion 46.

The top 43 of the housing 32 is coated with rhodium on both the interior 33 and the exterior 45. Alternatively, any white reflective metal (even highly polished yellow gold) may be used instead of rhodium, however, rhodium has a tendency to keep its shine and reflectivity for an extended period. Preferably, the rhodium coating 50 extends approximately two and one-half millimeters down the housing 32 on both the interior 33 and the exterior 45 sides of housing 32, but so long as the housing interior 33 and the top edge 43 are coated, the magnifying effect may be adequately obtained. Alternatively, the rhodium coating 50 may extend to the gem G at its edge E on the interior 33 of the housing 32, while the rhodium coating 50 may be extended to an exterior groove 44 on the outside 45 of the housing 32. The rhodium coating 50 complements the gem's appearance and enhances the visual presentation of the gem G made by the earring 30.

The gem G is recessed away from the top 43 of the housing 32. The rhodium coating 50 serves to reflect the gem's surface and sparkle. In this way, the rhodium coating 50 seems to extend the surface of the gem G so that the gem G appears magnified/larger. As the rhodium coated portion 50 of the housing 32 extends upward and slightly outward from the top of the gem G, the gem-like appearance of the gem G is also carried beyond the actual surface of the gem G in an upward and slightly outwardly manner. The gem G is recessed from the top edge 43 of the housing 32 and from a distance, this recession is not noticeable. In this way, a gem G of diminished proportions and lesser weight is allowed to shine and sparkle like one of greater weight as the gem's visual characteristics are extended by the rhodium coated portion of the housing 32 and enhanced by the reflecting, polished interior 33 of the housing 32. By setting gems (especially diamonds) within the housing 32, such gems appear fifty to one-hundred percent larger.

The post 34 is attached to the housing 32. If the small band 46 is not formed integrally with the housing 32, a blank die may be used to cut out the small band 46 that traverses the open lower end of the housing 32. The small band 46 may be constructed from the same material used to construct the housing 32. The small band 46 may be attached to the housing by solder, brazing, or other means known in the art of Jewelry making.

Upon, or even before, attaching the small band 46 to the lower portion of the housing 32, the post 34 is attached to the small band 46. The post 34 may be made of the same material used to construct the housing 32 and small band 46. The post 34 is attached to the small band 46 in a manner similar to that used to attach the small band 46 to the housing 32.

Two semicircular apertures 52, 54 are formed at the lower portion of the housing 32. These two semicircular apertures 52, 54 allow light to enter the interior 33 of the housing 32 from the rear, and provide the gem G with back lighting to enhance its appearance and sparkle.

After the post 34 has been attached to the housing 32 (by means of the small band 46, or by other appropriate and known means), the earring 30 is ready for insertion through a pierced earlobe or similar anatomical structure.

In order to hold the post 34 in place, a post holder 36 is used. Alternatively, "push backs" may be used as are known in the art. As shown in FIGS. 3 and 5, the post 34 passes through the post holder 36 and is held snugly by friction therein. Preferably,the post holder 36 has a post holding portion 38 and a pressure distributor 40. The pressure distributor 40 is formed around the post holding portion 38 so that the two may be easily manipulated. The post holding portion 38 fits snugly around the post 34. The pressure distributor 40 prevents the post holding portion 38 from rubbing and wearing against the ear lobe or other anatomical structure of the wearer of the earring 30 and stabilizes earrings 30 holding larger gems so that they are held straight within the ear lobe.

The post 34 is fully inserted through a pierced ear. The ear lobe is placed in contact with the bottom of the earring 30. The post 34 is then inserted through the post holder 36 until the ear lobe is fixed between the post holder 36 and the housing 32. A slight pressure is exerted on the ear lobe by both the post holder 36 and the bottom of housing 32. While this slight pressure is sufficient to hold the earring in place, it is enhanced by the pressure distributor 40. If the pressure distributor 40 were not present, the post holding portion 38 alone would be pressing against the back of the ear lobe. Pressure on the ear lobe would then be concentrated on the small contact area provided by the post holding portion 38 and blistering or irritation of the ear lobe could occur. The pressure distributor 40 in the post holder 36 prevents this blistering and irritation while at the same time providing a more secure support for the earring 30.

Figure 8:
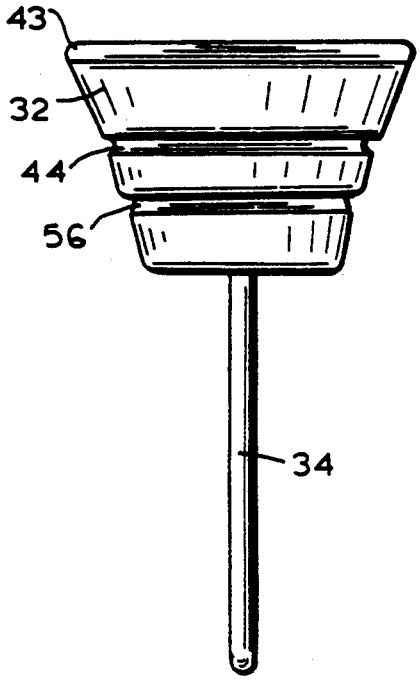
FIG. 8 is a side plan view of an alternative embodiment of the earring embodiment of the gem holder, showing a second exterior groove.
Figure 9:
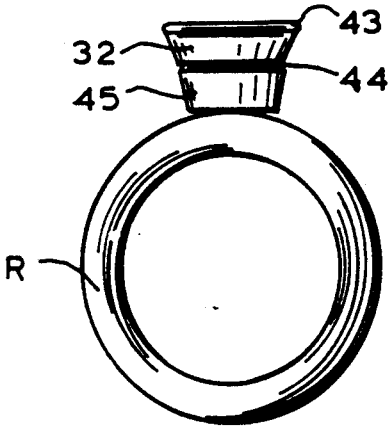
FIG. 9 is a side plan view of a ring incorporating the gem holder of the present invention.

Alternative embodiments of the present invention exist and are shown in FIGS. 8–13. FIG. 8 shows further external ornamentation of the exterior of the housing 32 by the addition of a second groove 56. FIG. 9 shows the gem holder of the current invention not as an earring for a pierced ear, but as a gem holder for a ring R.

FIGS. 10–13 show the magnifying gem holder of the present invention as earrings of different shapes for gems of popular, but different, cuts. FIG. 10 shows the earring gem holder for a gem cut in a square or princess cut. FIG. 11 shows the earring gem holder for a pear-shaped gem. FIG. 12 shows the earring gem holder for a gem cut in an oval shape. FIG. 13 shows an earring gem holder of the present invention for a gem cut in a marquis shape. For other gems, even those of random or natural cuts, a gem holder of the present invention may be fashioned to securely hold the gem and magnify and/or enhance the visual presentation of the gem.

FIGS. 10–13 show a further alternative embodiment of the present invention. The bottom portions of the gem holders shown in FIGS. 10–13 do not use small bands 46 to attach the post 34 to the housing 32. Instead, a flat plate of material (such as the material constructing the housing 32) has been either fixed to the base of the housing 32 or has been formed integrally with the housing 32. While back lighting of the gem G is not possible with a closed bottom portion of the housing 32, reflective material may be coated upon the interior of the housing 32 below the gem G to reflect light passing through the gem G back out the housing 32 to enhance the gem's sparkle and appearance.

While the present invention has been described with regards to particular embodiments, it is recognized that additional variations of the present invention may be devised without departing from the inventive concept.

What is claimed is:

1. In combination, a gem holder and a gem, said gem holder comprising:

a reflective housing defining a top edge and an upwardly diverging sidewall therebelow; and means for holding said gem securely and stationary within said reflective housing, said holding means being associated with said reflective housing and holding said gem in a manner such that said gem is recessed in its entirety below said top edge of said reflective housing.

2. The gem holder of claim 1, wherein said means for securely holding a gem within said reflective housing comprises said housing defining a groove in said housing away from the top edge of said housing.

3. The gem holder of claim 1, wherein said reflective housing defines apertures at the lower end of said housing so that a gem set within said housing may be backlit.

4. The gem holder of claim 1, wherein said reflective housing further comprises a coating of reflective material near its top.

5. The gem holder of claim 4, wherein said reflective coating comprises rhodium.

6. The gem holder of claim 1, wherein said housing is conical in shape.

7. The gem holder of claim 6, wherein said housing has a conical angle of approximately sixteen to twenty-four degrees for gems of approximately five to fifteen points in weight.

8. The gem holder of claim 6, wherein said housing has a conical angle of approximately twenty-four to thirty degrees for gems of approximately fifteen to twenty-five points in weight.

9. The gem holder of claim 6, wherein said housing has a conical angle of approximately thirty to thirty-six degrees for gems of approximately twenty-five to fifty points in weight.

10. The gem holder of claim 6, wherein said housing has a conical angle of approximately thirty-six to forty-two degrees for gems of approximately fifty points to one carat in weight.

11. The gem holder of claim 6, wherein said housing has a conical angle of approximately thirty-eight to forty-four degrees for gems of approximately one to one and one-half carats in weight.

12. The gem holder of claim 6, wherein said housing has a conical angle of approximately forty-two to forty-eight degrees for gems of approximately one and one-half to two carats in weight.

13. In combination, a gem holder and a gem, said gem holder comprising:

a conical, highly-polished housing defining a top edge and a reflective surface, including a top portion coated with reflective metal;

said housing defining, within said housing and away from said top edge of said housing, a groove of sufficient depth and circumference to securely hold said gem stationary and recessed in its entirety below said top edge of said housing;

whereby said gem is magnified by appearing larger than its actual size due to reflection of said gem by said housing.

14. The gem holder of claim 13, wherein the conical angle of said conical housing is increased with greater gem weight and decreased with smaller gem weight so that the light reflected by the housing enhances the gem's appearance.

15. The gem holder of claim 13, wherein said housing has conical angle of:

approximately sixteen to twenty-four degrees for gems of approximately five to fifteen points in weight;

approximately twenty-four to thirty degrees for gems of approximately fifteen to twenty-five points in weight;

approximately thirty to thirty-six degrees for gems of approximately twenty-five to fifty points in weight;

approximately thirty-six to forty-two degrees for gems of approximately fifty points to one carat in weight;

approximately thirty-eight to forty-four degrees for gems of approximately one to one and one-half carats in weight; and approximately forty-two to forty-eight degrees for gems of approximately one and one-half to two carats in weight.

* * * * *